US012480655B2

(12) United States Patent
Kamoi et al.

(10) Patent No.: US 12,480,655 B2
(45) Date of Patent: Nov. 25, 2025

(54) COMBUSTOR FOR GAS TURBINE ENGINE

(71) Applicant: HONDA MOTOR CO., LTD., Tokyo (JP)

(72) Inventors: Yasuharu Kamoi, Saitama (JP); Toshiyuki Tsuji, Saitama (JP); Tomomitsu Karube, Saitama (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 19/022,184

(22) Filed: Jan. 15, 2025

(65) Prior Publication Data

US 2025/0244014 A1 Jul. 31, 2025

(30) Foreign Application Priority Data

Jan. 30, 2024 (JP) ..... 2024-011892

(51) Int. Cl.
*F23R 3/00* (2006.01)
*F23R 3/06* (2006.01)

(52) U.S. Cl.
CPC ..... *F23R 3/002* (2013.01); *F23R 3/06* (2013.01); *F23R 2900/03042* (2013.01)

(58) Field of Classification Search
CPC .... F23R 3/002; F23R 3/04; F23R 3/06; F23R 2900/03041–03045
See application file for complete search history.

(56) References Cited

U.S. PATENT DOCUMENTS 2,871,546 A * 2/1959 Conrad ..... F23R 3/08 228/15.1
3,359,724 A * 12/1967 Barnwell ..... F23R 3/08 60/266
3,420,058 A * 1/1969 Howald ..... F23R 3/08 29/455.1
3,737,152 A * 6/1973 Wilson ..... F23R 3/08 60/757
3,811,276 A * 5/1974 Caruel ..... F23R 3/08 60/757
4,242,871 A * 1/1981 Breton ..... F23R 3/002 60/757
4,485,630 A * 12/1984 Kenworthy ..... F23R 3/002 60/757
4,738,588 A * 4/1988 Field ..... F01D 5/186 415/115
4,773,593 A * 9/1988 Auxier ..... F01D 5/184 239/127.3
4,821,387 A * 4/1989 Bouillot ..... B23B 1/00 60/757

(Continued)

*Primary Examiner* — Alain Chau
(74) *Attorney, Agent, or Firm* — Armstrong Teasdale LLP

(57) ABSTRACT

A combustor for a gas turbine engine that is placed in a compressed air chamber of the gas turbine engine to generate combustion gas, the combustor being provided with a liner that defines a combustion chamber therein around a prescribed central axis, the liner comprising a plurality of raised wall portions that extends in a circumferential direction at an angle with respect to the central axis and are arranged at predetermined intervals along the central axis, a plurality of cooling air holes passed through the raised wall portions, and thick wall portions provided circumferentially in parts of the raised wall portions at ends of the cooling air holes.

7 Claims, 12 Drawing Sheets

(56) References Cited

U.S. PATENT DOCUMENTS

| | | | | |
|---|---|---|---|---|
| 5,329,773 | A * | 7/1994 | Myers | F23R 3/08 60/757 |
| 8,677,759 | B2 * | 3/2014 | Kaleeswaran | F23R 3/04 60/754 |
| 11,085,641 | B2 * | 8/2021 | Dudebout | F23R 3/04 |
| 11,371,703 | B2 * | 6/2022 | Moura | F23R 3/045 |
| 11,519,604 | B2 * | 12/2022 | Dudebout | F23R 3/06 |
| 11,754,285 | B2 * | 9/2023 | Kamoi | F23R 3/002 60/752 |
| 11,867,402 | B2 * | 1/2024 | Quach | F23R 3/002 |
| 12,085,279 | B1 * | 9/2024 | Anderson | F23R 3/005 |
| 2005/0050896 | A1 * | 3/2005 | McMasters | F23M 5/085 60/752 |
| 2013/0074507 | A1 | 3/2013 | Kaleeswaran et al. | |
| 2013/0160453 | A1 * | 6/2013 | Kimura | F23R 3/06 60/725 |
| 2017/0176006 | A1 * | 6/2017 | Gerendas | F23R 3/06 |
| 2019/0017440 | A1 * | 1/2019 | Porter | F23R 3/06 |
| 2022/0307693 | A1 * | 9/2022 | Kamoi | F23R 3/002 |

* cited by examiner

COMBUSTOR FOR GAS TURBINE ENGINE

TECHNICAL FIELD

The present invention relates to a combustor for a gas turbine engine.

BACKGROUND ART

In a gas turbine engine, a combustor for generating combustion gas is placed in a compressed air chamber. The combustor is provided with a liner (housing) consisting of a wall member that defines a combustion chamber. The liner is required to be suitably cooled in order to withstand the heat from the combustion gas. In order to cool the liner, a part of the compressed air is flown along the inner surface of the liner. To improve the cooling efficiency, it has been proposed to provide a plurality of undulations in the liner along the axial direction thereof, and form cooling air holes in the liner so that a film of air is formed along the surface of the liner facing the combustion chamber. See US2013/0074507A1, for instance.

In such a combustor, the film of air formed along the inner surface of the liner prevents the liner from being excessively heated by the combustion gas in the combustor.

In order to effectively cool the liner by the cooling air ejected from the cooling air holes into the combustion chamber, it is desired that the cooling air flows closely along the inner surface of the liner facing the combustion chamber.

For this purpose, the air flow along the inner surface of the liner is desired to be a laminar flow free from turbulence as much as possible. To achieve this goal, it is advantageous to direct the air flow along the inner surface of the liner and reduce the flow velocity of the cooling air as much as possible. If the cross-sectional area of each cooling air hole is progressively increased in the direction of the air flow, the flow velocity of the cooling air can be reduced without creating turbulence.

However, in order to effectively decelerate the cooling air within the cooling air holes provided in the liner, it is necessary to increase the passage length of the cooling air holes. Increasing the passage length of the cooling air holes requires the wall thickness of the liner to be increased, and this necessitates an increase in the weight of the combustor, and causes an undesired increase in the weight of the gas turbine engine.

SUMMARY OF THE INVENTION

In view of such a problem of the prior art, a primary object of the present invention is to provide a combustor for a gas turbine engine that can effectively decelerate the velocity of the cooling air (cooling air flow) that flows through the cooling air holes and favorably cool the liner of the combustor while avoiding an increase in the weight of the combustor.

To achieve such an object of the present invention, an aspect of the present invention provides a combustor (18) for a gas turbine engine (10) that is placed in a compressed air chamber (44) of the gas turbine engine to generate combustion gas, the combustor being provided with a liner (100) that defines a combustion chamber (46) therein around a prescribed central axis, the liner comprising: a plurality of raised wall portions (114) that extends in a circumferential direction at an angle with respect to the central axis and are arranged at predetermined intervals along the central axis; a plurality of cooling air holes (120) passed through the raised wall portions; and thick wall portions (122) provided circumferentially in parts of the raised wall portions at ends of the cooling air holes.

According to this aspect, the passage length of the cooling air holes is increased so that the cooling air flowing through the cooling air holes into the combustion chamber is effectively decelerated while the increase in the weight of the combustor is minimized. In this case, the combustor may be either an annular type or a can type.

In the above aspect, preferably, the thick wall portions are provided at inlets (120A) and/or outlets (120B) of the cooling air holes.

According to this aspect, the design freedom for providing the thick wall portions is increased.

In the above aspect, preferably, the thick wall portions are individually formed in an arcuate shape at the ends of the cooling air holes.

Alternatively, the thick wall portions may be provided circumferentially and continuously so as to cross inlets and/or outlets of the cooling air holes.

According to these aspects, the increase in the weight of the liner due to the thick wall portions is minimized.

In the above aspect, preferably, the cooling air holes each include a flared portion that flares from a side of the compressed air chamber to a side of the combustion chamber.

According to this aspect, since the cross-sectional area of the flared portions progressively increases with respect to the flowing direction of the cooling air, the cooling air flowing through the cooling air holes into the combustion chamber is effectively decelerated so that the liner is effectively cooled.

In the above aspect, preferably, the flared portions are progressively enlarged in a circumferential direction from a side of the compressed air chamber to a side of the combustion chamber.

According to this aspect, the cooling air flowing along the wall surface of the combustion chamber is less likely to separate from the wall surface so that the liner is effectively cooled.

In the above aspect, preferably, the flared portions have a trapezoidal cross-sectional shape with a long side thereof located on a radially outer side.

According to this aspect, the cooling air flowing along the wall surface of the combustion chamber is less likely to separate from the wall surface so that the liner is effectively cooled.

In the above aspect, preferably, the flared portions have a triangular cross-sectional shape with a base thereof located on a radially outer side.

According to this aspect, the cooling air flowing along the wall surface of the combustion chamber is less likely to separate from the wall surface so that the liner is cooled effectively.

In the above aspect, preferably, the liner further includes inclined wall portions (116) that are inclined radially inward along the central axis with respect to a flow direction of the combustion gas so as to alternate with the raised wall portion along the central axis.

According to this aspect, the cooling air flowing through the cooling air holes into the combustion chamber is more likely to flow along the wall surface of the inclined wall portions that form a part of the liner.

In the above aspect, preferably, the liner further includes cylindrical wall portions that are substantially less inclined than the inclined wall portions and each positioned between one of the raised wall portions and the adjoining inclined wall portion on an upstream side or a downstream side thereof.

According to this aspect, the cooling air flowing through the cooling air holes into the combustion chamber is more likely to flow along the wall surface of the inclined wall portions that form a part of the liner.

Thus, the present invention provides a combustor for a gas turbine engine that can effectively decelerate the velocity of the cooling air (cooling air flow) that flows through the cooling air holes and favorably cool the liner of the combustor while avoiding an increase in the weight of the combustor.

DESCRIPTION OF THE PREFERRED EMBODIMENT(S)

Figure 1:
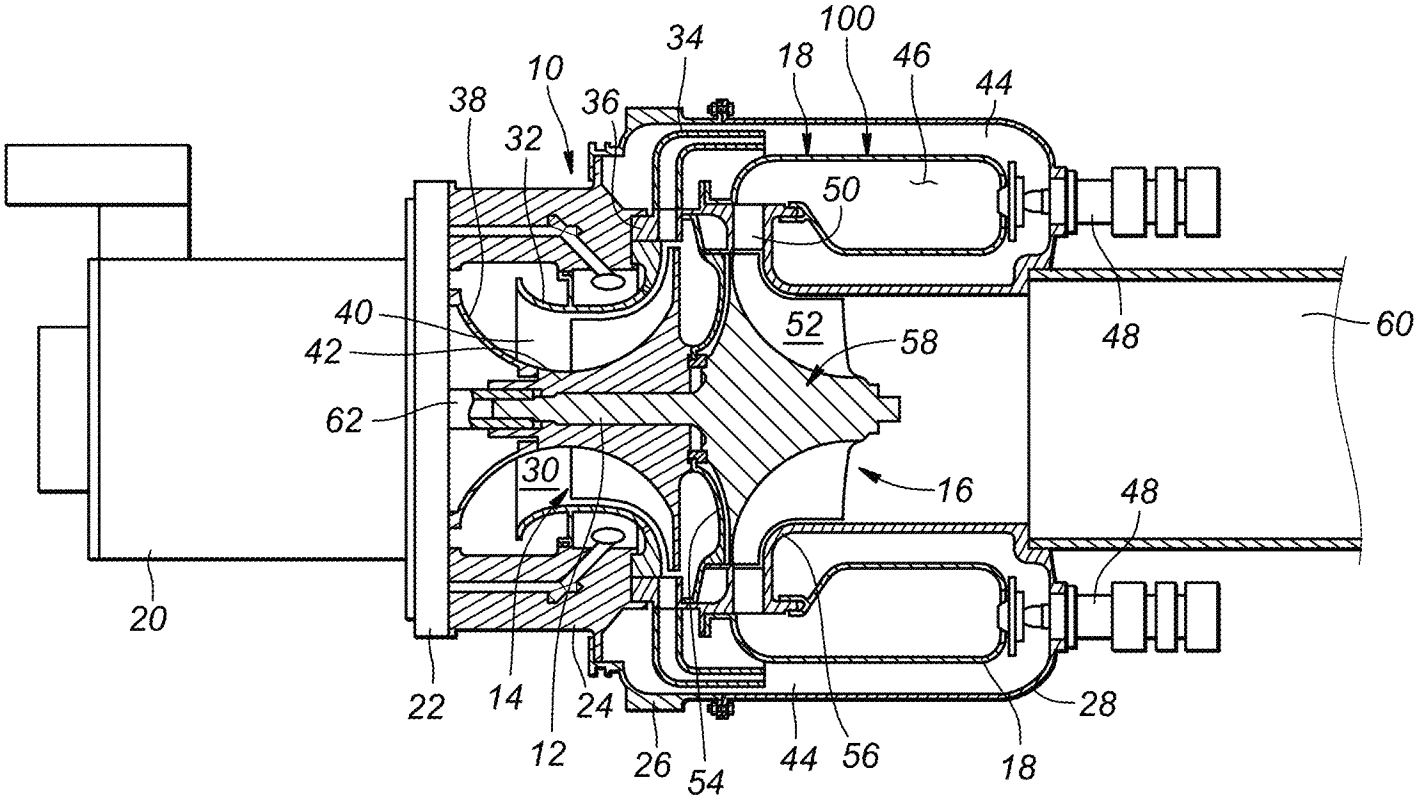
FIG. 1 is a schematic diagram of a gas turbine engine fitted with a combustor according to an embodiment of the present invention.

FIG. 1 is a sectional view of a gas turbine engine system 10 for electric power generation fitted with a combustor according to an embodiment of the present invention. As shown in FIG. 1, the gas turbine engine system 10 comprises a radial compressor 14 and a radial turbine 16 which are disposed coaxial to each other and connected to each other via a rotatable shaft 12. The rotatable shaft 12 is further connected to the input shaft of an electric generator 20.

The gas turbine engine system 10 is provided with a front end plate 22, a front housing 24, an intermediate housing 23 and a rear housing 28 connected to one another in this order. The electric generator 20 is connected to the electric generator 20 at the front end plate 22.

The radial compressor 14 is provided with a compressor liner 32 attached to the front housing 24 to define a compressor chamber 30, a diffuser 34 attached to the front housing via a diffuser fixing member 36, and an air intake guide member 38 attached to the front end plate 22 so as to define an annular air intake 40 in cooperation with the compressor liner 32. A compressor rotor 42 attached to the rotatable shaft 12 is rotatably positioned in the compressor chamber 30. The compressor rotor 42 is rotated by the rotatable shaft 12 which is the output shaft of the radial turbine 16 as will be discussed hereinafter.

The radial compressor 14 draws air (outside air) from the air intake 40, compresses and pressurizes the air by the rotation of the compressor rotor 42, and forwards the compressed and pressurized air (compressed air) into the diffuser 34.

The rear housing 28 includes a part that defines a compressed air chamber 44 into which compressed air is introduced from the diffuser 34. The compressed air chamber 44 has an annular cross-sectional shape about the central axis of the rotatable shaft 12. A combustor 18 is provided in the compressed air chamber 44. The combustor 18 defines a combustion chamber 46 which has an annular cross-sectional shape about the central axis of the rotatable shaft 12. A plurality of fuel injection nozzles 48 is provided in the combustor 18. The fuel injection nozzles 48 inject fuel into the combustion chamber 46.

The combustors 18 are provided inside the rear housing 28 around the central axis of the rotatable shaft 12. The rear housing 28 includes a part that defines a compressed air chamber 44 into which compressed air is introduced from the diffuser 34. Each combustor 18 defines a combustion chamber 46. A plurality of fuel injection nozzles 48 is attached to the combustor 18 to inject fuel into the combustion chamber 46. In the combustion chamber 46, a mixture of the fuel injected into the combustion chamber 46 by the fuel injection nozzles 48 and the compressed air from the radial compressor 14 is combusted to generate high-temperature combustion gas (compressed fluid). A turbine nozzle 50 is provided at the gas outlet of the combustor 18.

The radial turbine 16 is provided with a turbine chamber 52 that is defined by an inner part of the rear housing 28 and communicates with the gas outlet of the combustor 18. The turbine chamber 52 is separated from the compressor chamber 30 by a partition member 54. The side of the turbine chamber 52 remote from the partition member 54 along the central axis is defined by a shroud 56. A radial turbine impeller 58 that is integrally formed with the rotatable shaft 12 is rotatably positioned in the turbine chamber 52.

The turbine nozzle 50 is annular in shape and surrounds the radial turbine impeller 58, and forwards combustion gas radially inward and circumferentially toward the radial turbine impeller 58. The combustion gas ejected from the turbine nozzle 50 rotationally drives the radial turbine impeller 58. The combustion gas that has rotationally driven the radial turbine impeller 58 is expelled to the atmosphere from an exhaust gas passage 60 defined by a cylindrical member connected to the rear end of the rear housing 28.

The rotatable shaft 12 is connected to a rotor shaft 62 of the generator 20. Thus, the rotatable shaft 12 of the radial turbine 16 drives the generator 20 to generate electric power.

The details of the combustor 18 will be described in the following with reference to FIGS. 1 to 7.

Figure 2:
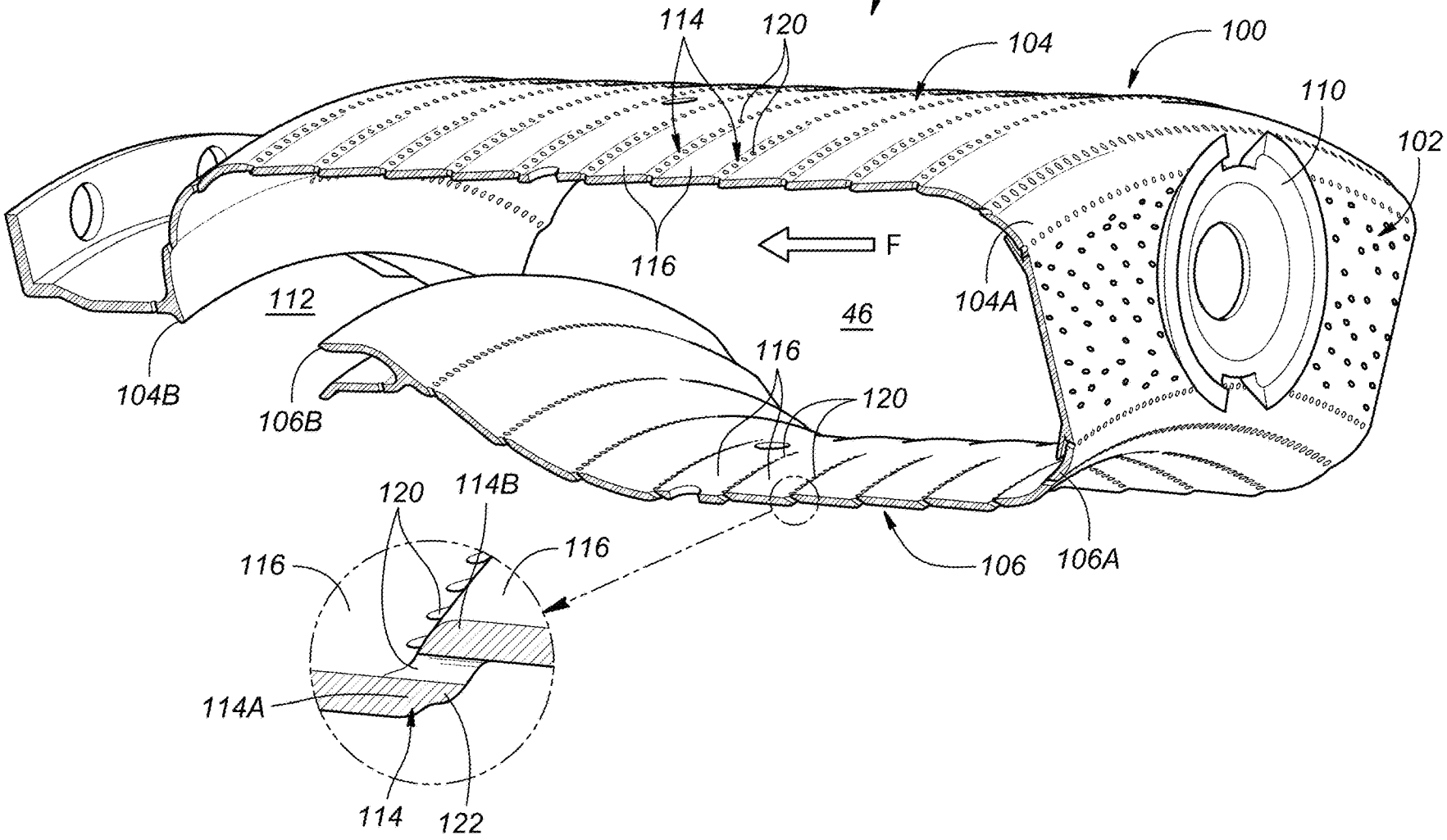
FIG. 2 is a perspective view of the combustor partly in section; a simplified vertical sectional view of the gas turbine engine.

The combustor 18 of the illustrated embodiment consists of an annular combustor, and as shown in FIG. 1, has a liner (housing) 100 disposed approximately concentrically within the annular compressed air chamber 44. As shown in FIG. 2, the liner 100 includes an annular end wall 102 extending substantially orthogonally to the central axis, an outer peripheral wall 104 extending in the axial direction and connected to the outer peripheral edge of the end wall 102 at a first end 104A thereof, and an inner peripheral wall 106 also extending in the axial direction and connected to the inner peripheral edge of the end wall 102 at a first end 106A thereof, defining the annular combustion chamber 46 around the central axis.

The liner 100 is manufactured by the AM (Additive Manufacturing) process, in which metal is layered from bottom to top, with the end wall 102 facing downward and the central axis of the liner 100 extending vertically.

The outer surface of the liner 100 is exposed to the flow of compressed air in the compressed air chamber 44 so that the liner 100 is cooled by the compressed air flowing along the outer surface thereof.

A plurality of mounting portions 110 is formed on the end wall 102 at predetermined intervals in the circumferential direction for mounting the corresponding fuel injection nozzles 48 thereto. Each fuel injection nozzle 48 mixes fuel (supplied via a fuel supply passage not shown in the drawings) with the compressed air in the compressed air chamber 44 and injects the resulting mixture into the combustion chamber 46. In the combustion chamber 46, the mixture is combusted, and generates high-temperature combustion gas.

The second ends 104B, 106B of the outer peripheral wall 104 and the inner peripheral wall 106 oppose each other so as to jointly define an annular combustion gas outlet 112 which faces radially inward. The combustion gas outlet 112 communicates with the turbine nozzle 50 (see FIG. 1) of the radial turbine 16 to supply combustion gas to the radial turbine 16.

The combustion gas created in the combustion chamber 46 flows from the side of the end wall 102 to the combustion gas outlet 112 as indicated by letter F in FIG. 2.

Figure 3:
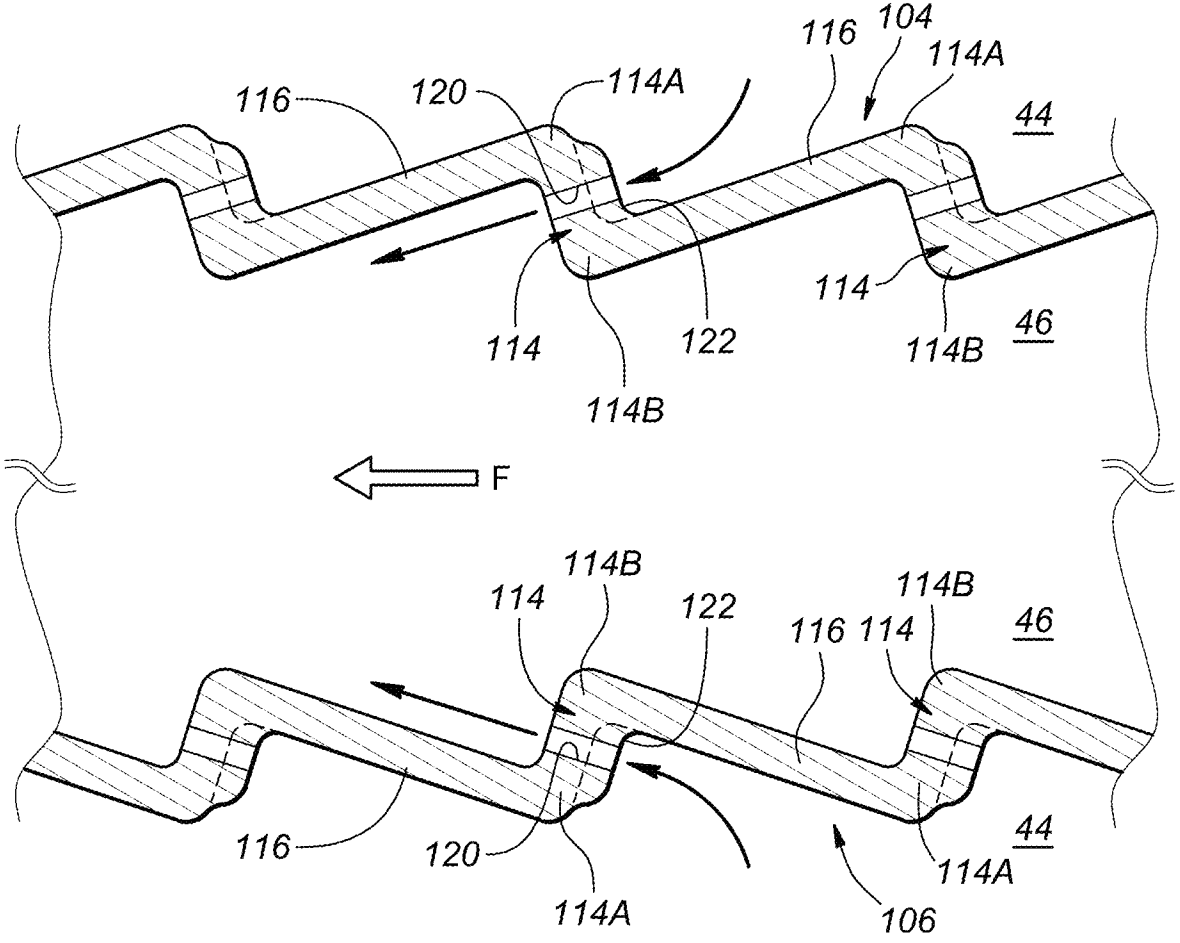
FIG. 3 is a fragmentary sectional view of the combustor.

Each of the outer peripheral wall 104 and the inner peripheral wall 106 is provided with a plurality of raised wall portions 114 extending in the circumferential direction and spaced at a predetermined interval in the axial direction, and an inclined wall portion 116 connects each pair of adjacent raised wall portions 114. More specifically, as shown in FIG. 3, each inclined wall portion 116 extends circumferentially around the central axis between an outer edge portion 114A (a radially outer edge) of the adjacent raised wall portion 114 on the upstream side with respect to the flow direction F of the combustion gas and an inner edge portion 114B (radially inner edge) of the adjacent raised wall portion 114 on the downstream side with respect to the flow direction F of the combustion gas.

In this embodiment, each raised wall portion 114 rises radially outward and each inclined wall portion 116 descends radially inward as one moves in the direction of the combustion gas in the combustion chamber 46. In other words, with respect to the flow direction F of the combustion gas in the combustion chamber 46, each inclined wall portion 116 is connected to the inner edge portion 114B of the downstream raised wall portion 114 at the front edge thereof and to the outer edge portion 114A of the upstream raised wall portion 114 at the rear edge thereof, and is inclined so that the front edge of each inclined wall portion 116 is located radially inward of the rear edge thereof.

The raised wall portions 114 are inclined substantially more steeply than the inclined wall portions 116. Each raised wall portion 114 slopes radially outward with respect to the flow direction F of the combustion gas in the combustion chamber 46 whereas each inclined wall portion 116 slopes radially inward with respect to the flow direction F of the combustion gas in the combustion chamber 46. In this embodiment, each raised wall portion 114 forms approximately a right angle with the adjacent inclined wall portion 116 in the longitudinal sectional view as shown in FIG. 3. Further, the raised wall portions 114 and the inclined wall portions 116 extend linearly in the longitudinal sectional view and thereby each defining a conical shape as shown in FIG. 3.

As shown in FIG. 2, a plurality of cooling air holes 120 is formed through each of the raised wall portions 114 at a predetermined interval in the circumferential direction and extends substantially linearly and perpendicularly to the raised wall portion 114 in the longitudinal sectional view. In this embodiment, the cooling air holes 120 are arranged in a single row along the circumferential direction of the raised wall portion 114.

Figure 4:
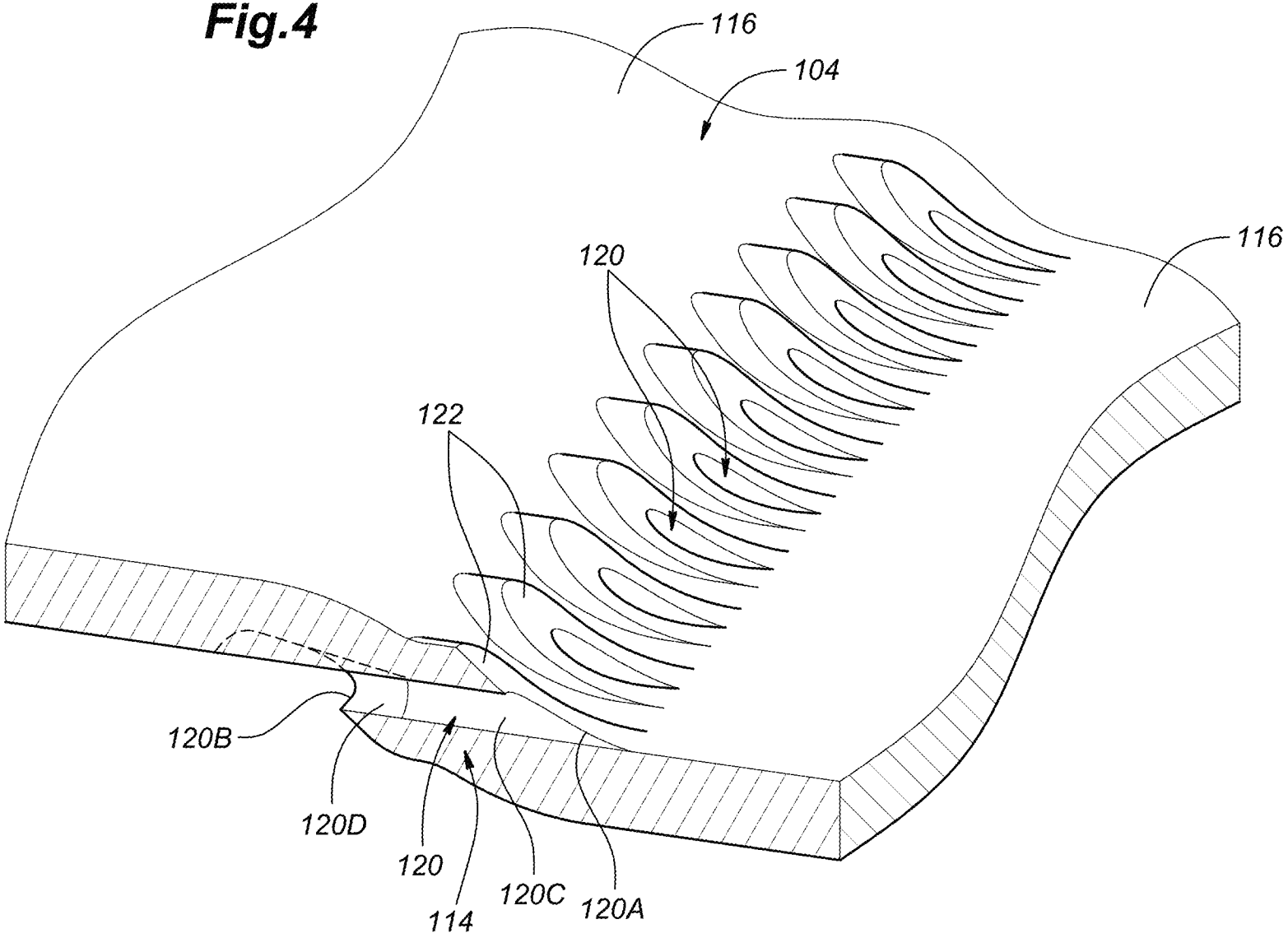
FIG. 4 is a fragmentary perspective view of an essential part of the combustor partly in section.
Figure 5:
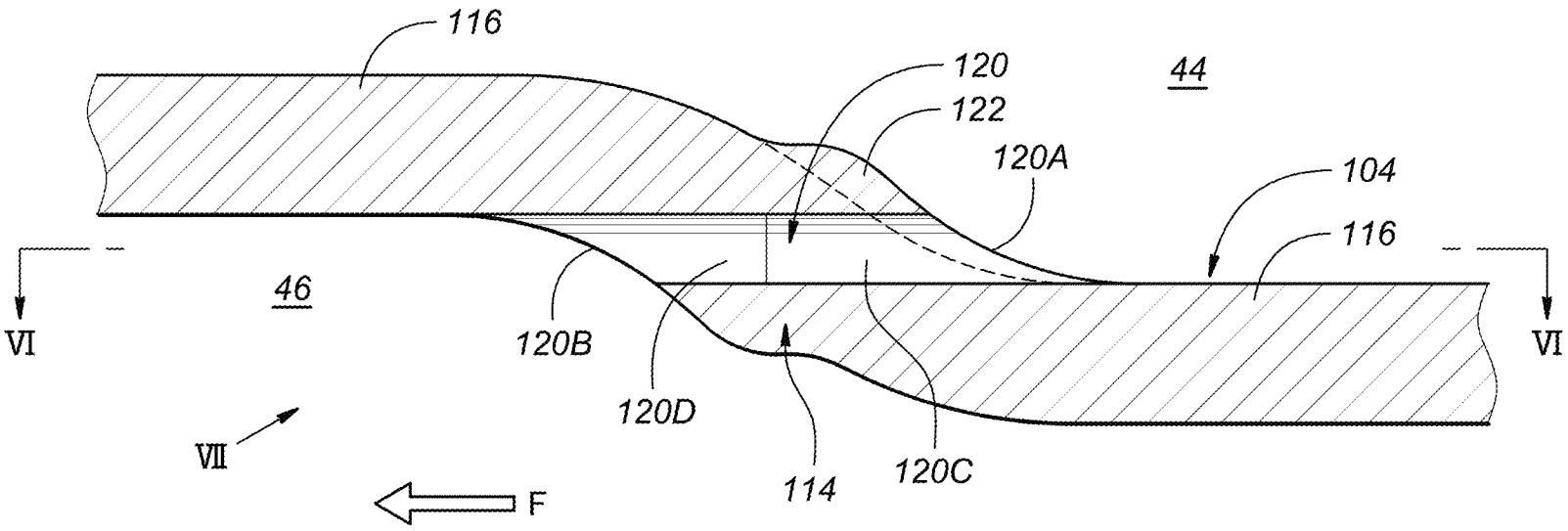
FIG. 5 is an enlarged sectional view of the essential part of the combustor.
Figure 6:
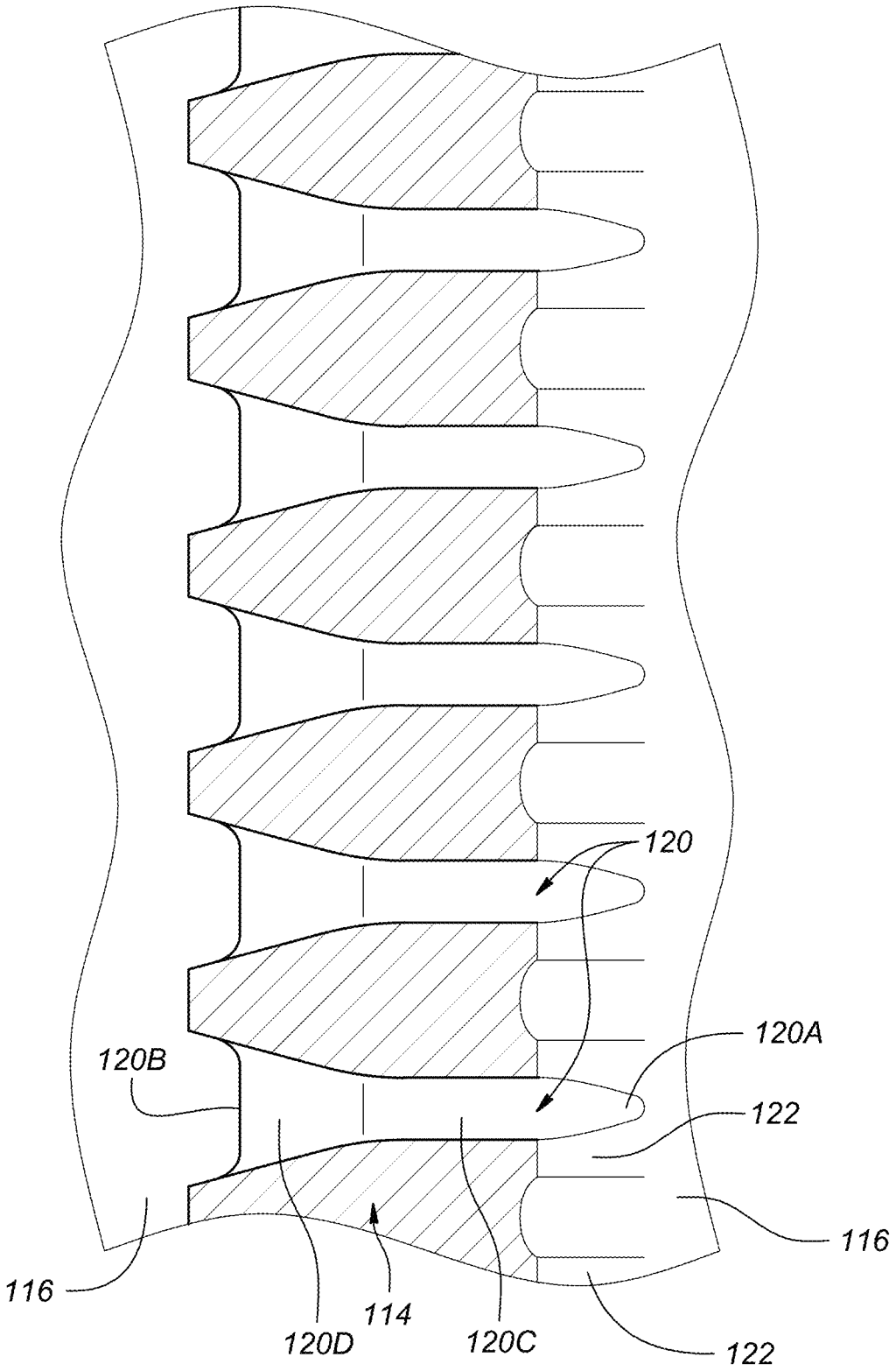
FIG. 6 is a sectional view taken along line VI-VI of FIG. 5.
Figure 7:
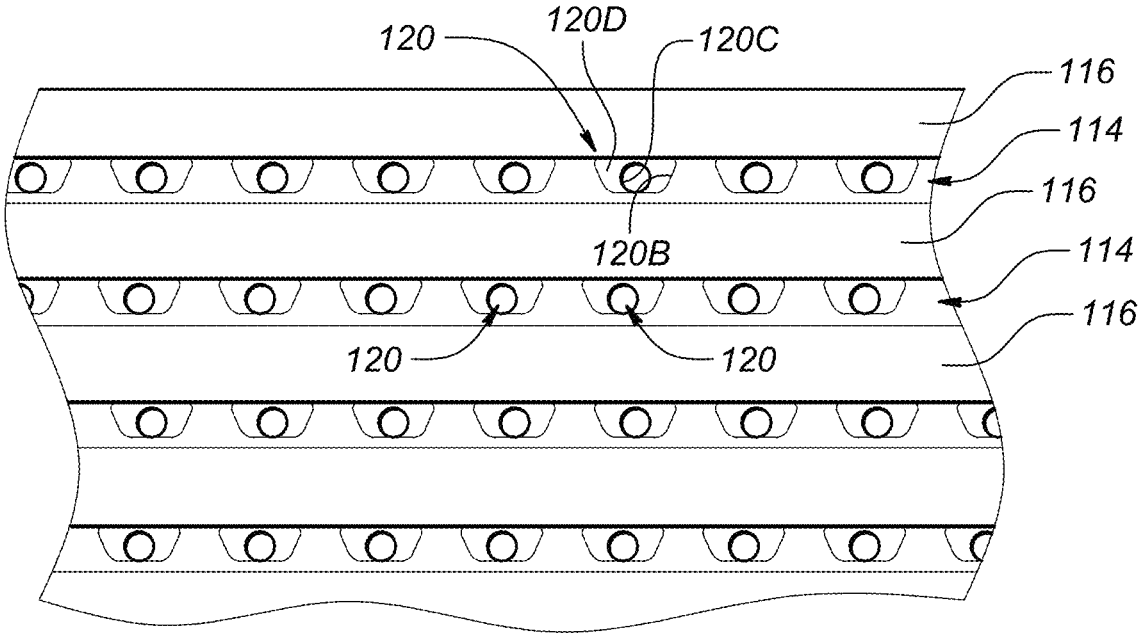
FIG. 7 is a view of cooling air holes formed in the liner of the combustor as viewed from the inside of the combustor according to another embodiment of the present invention.

As shown in FIG. 4 to FIG. 6, each cooling air hole 120 has an inlet 120A that opens toward the compressed air chamber 44 and an outlet 120B that opens toward the combustion chamber 46. Compressed air from the compressed air chamber 44 flows into each cooling air hole 120 from the inlet 120A as cooling air, flows through cooling air hole 120 and is ejected from the outlet 120B into the combustion chamber 46.

Each cooling air hole 120 includes an upstream portion 120C on the side of the inlet 120A (the side of the compressed air chamber 44) having a circular cross section of a substantially constant inner diameter along the longitudinal direction thereof, and a downstream portion 120D (flared portion) on the side of the outlet 120B (the side of the combustion chamber 46) consisting of a shaped hole which progressively increases in diameter from the side of the compressed air chamber 44 to the side of the combustion chamber 46. Each cooling air hole 120 is inclined with respect to the axial direction at an inclination angle substantially equal to the inclination angle of the part of the inner surface of the inclined wall portion 116 located downstream of the outlet 120B with respect to the axial direction.

The downstream portion 120D (the side of the combustion chamber 46) of each cooling air hole 120 progressively widens in the circumferential direction toward the outlet 120B and has a trapezoidal cross section (see FIG. 6) with the longer side thereof located on the radially inner side.

The inlet 120A of each cooling air hole 120 is provided with an arch-shaped thick wall portion 122 formed individually on the outer periphery of the cooling air hole 120 as an extension of the corresponding raised wall portion 114. Each thick wall portion 122 extends the upstream portion 120C of the corresponding cooling air hole 120 toward the inlet 120A by the added thickness of the thick wall portion 122, thereby increasing the overall passage length of the cooling air hole 120.

Since the passage length of each cooling air hole 120 is extended owing to the presence of the thick wall portion 122, the compressed air (cooling air) injected from the outlet 120B into the combustion chamber 46 is sufficiently decelerated. This reduces the tendency of the cooling air injected from each of the cooling air holes 120 to separate from the inner surface of the outer peripheral wall 104 or the inner peripheral wall 106, and the cooling air flows in a layer (as a film) along the inner surface of the outer peripheral wall 104 or the inner peripheral wall 106. This effectively cools the outer peripheral wall 104 or the inner peripheral wall 106.

Since the passage length of each cooling air hole 120 is increased by the arch-shaped thick wall portion 122 formed individually around the outer periphery of the inlet 120A, the passage length of each cooling air hole 120 is extended without increasing the overall thickness of the outer peripheral wall 104 or the inner peripheral wall 106. Thus, the passage length of each cooling air hole 120 is increased without increasing the overall wall thickness of the combustor 18. Furthermore, because each thick wall portion 122 is arch-shaped and individually surrounds the outer periphery of the inlet 120A of the corresponding cooling air hole 120, an increase in the weight of the combustor 18 due to the thick wall portion 122 is kept small.

Potential failures of the liner 100 of the combustor 18 include cracks that could develop from the edge (at the inlet or outlet) of the cooling air hole 120. A structure such as the thick wall portion 122 that extends only around the inlet or outlet of each cooling air hole 120 relieves stress generated at the edge of the cooling air hole 120 so that the occurrence of cracks originating from the edge of the hole can be avoided, and the durability of the combustor 18 can be improved. In addition, by lengthening the passage length of the upstream portion 120C of the cooling air hole 120, the length over which the diameter of the cooling air hole 120 is constant increases. As a result, when the liner 100 is manufactured by the AM process, the variations in flow rate due to the variations in the surface properties of the upstream portion 120C of the cooling air hole 120 that could be caused during the stacking process of the AM process can be minimized. As a result, the variations in the total flow rate of the numerous cooling air holes 120 are also suppressed.

The downstream portion 120D of each cooling air hole 120 is expanded from the side of the compressed air chamber 44 towards the side of the combustion chamber 46, and the cross-sectional area progressively and smoothly increases towards the combustion chamber 46, so that the flow velocity of the cooling air flowing out into the combustion chamber 46 is reduced and the outer peripheral wall 104 and the inner peripheral wall 106 are cooled more effectively.

In addition, each cooling air hole 120 is inclined with respect to the axial direction at an angle substantially equal to the inclination angle of the inner surface of the inclined wall portion 116 with respect to the axial direction, and this promotes the tendency of the cooling air to flow along the inner surfaces of the outer peripheral wall 104 and the inner peripheral wall 106. Further, the downstream portion 120D of each cooling air hole 120 has a trapezoidal cross section that is elongated in the circumferential direction and has a long side on the radially outer side, and this promotes the cooling air to flow in a layer along the inner surfaces of the outer peripheral wall 104 and the inner peripheral wall 106, thereby effectively cooling the outer peripheral wall 104 and the inner peripheral wall 106.

As described above, by effectively cooling the outer peripheral wall 104 and the inner peripheral wall 106, it is possible to increase the temperature of the combustion gas in the combustor 18, which in turn makes it possible to increase the pressure ratio of the compressor, thereby improving the efficiency of the gas turbine engine.

Figure 8:
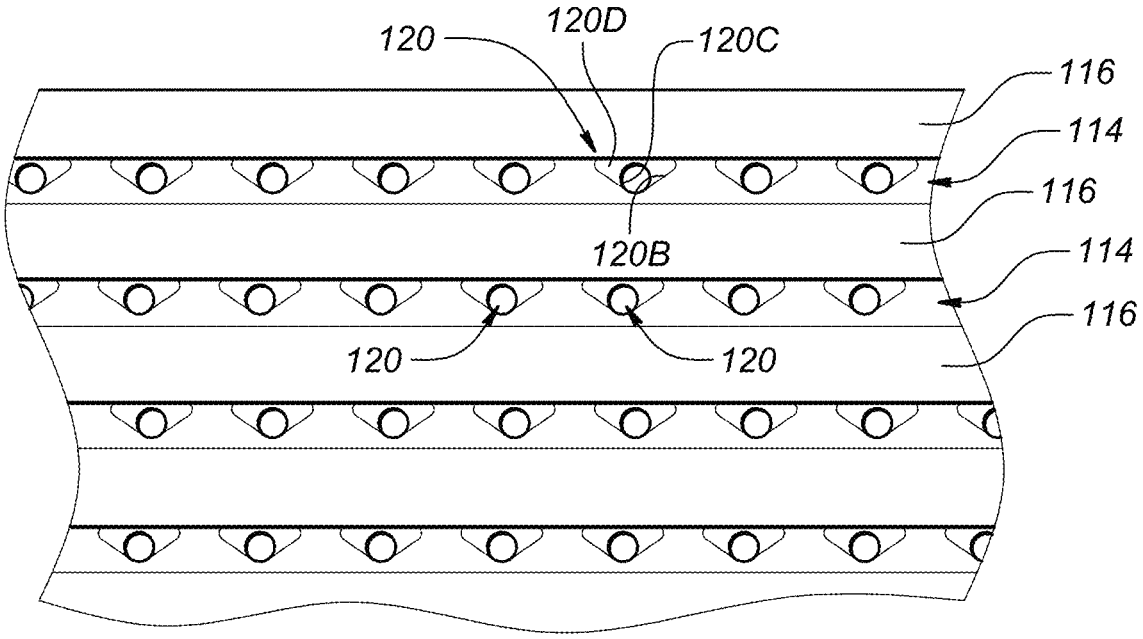
FIG. 8 is a view similar to FIG. 8 according to yet another embodiment of the present invention.

FIG. 8 shows the passage shape of the downstream portion 120D of each cooling air hole 120 according to another embodiment of the present invention. In this embodiment, the downstream portion 120D (the side of the combustion chamber 46) of each cooling air hole 120 progressively expands in the circumferential direction toward the outlet 120B and has a triangular cross section with a long side located on the radially outer side.

According to this embodiment as well, the cooling air flowing in a layer along the inner surfaces of the outer peripheral wall 104 and the inner peripheral wall 106 is less likely to separate from the wall surfaces so that the outer peripheral wall 104 and the inner peripheral wall 106 are effectively cooled. According to yet another embodiment of the present invention, the downstream portion 120D (the side of the combustion chamber 46) of each cooling air hole 120 has an elliptic or oblong cross-sectional shape that is elongated in the circumferential direction.

Figure 9:
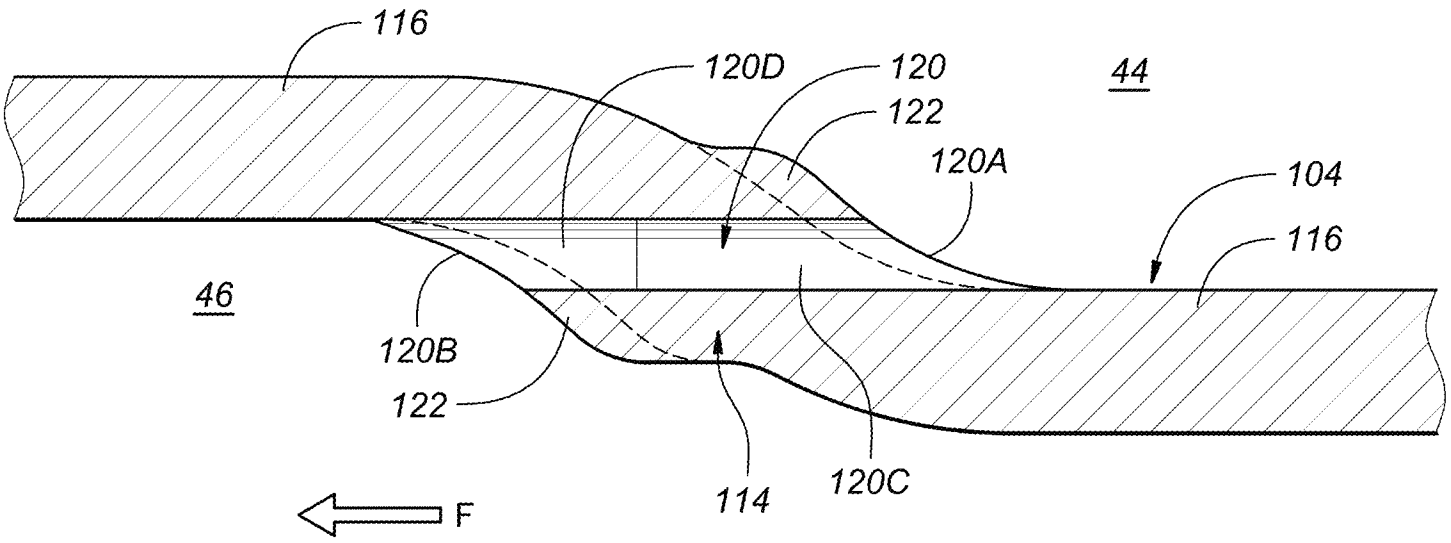
FIG. 9 is a view similar to FIG. 6 according to yet another embodiment of the present invention.

The thick wall portion 122 provided for each cooling air hole 120 in the raised wall portion 114 to extend the passage length of the cooling air hole 120 may be provided on the outlet 120B of the cooling air hole 120 in addition to or instead of the inlet 120A of each cooling air hole 120 as shown in FIG. 9.

By providing the thick wall portions 122 on the inlet 120A and the outlet 120B of the cooling air hole 120, the passage length of the cooling air hole 120 is further increased, and the cooling air flowing through the cooling air hole 120 is further decelerated. As a result, the cooling air flowing in a layer along the inner surfaces of the outer peripheral wall 104 and the inner peripheral wall 106 is less likely to separate from the wall surfaces so that the outer peripheral wall 104 and the inner peripheral wall 106 are effectively cooled.

The thick wall portions 122 may be provided only on the outlet 120B side of the cooling air holes 120. These features increase the degree of freedom in the design of the liner 100 of the combustor 18.

Figure 10:
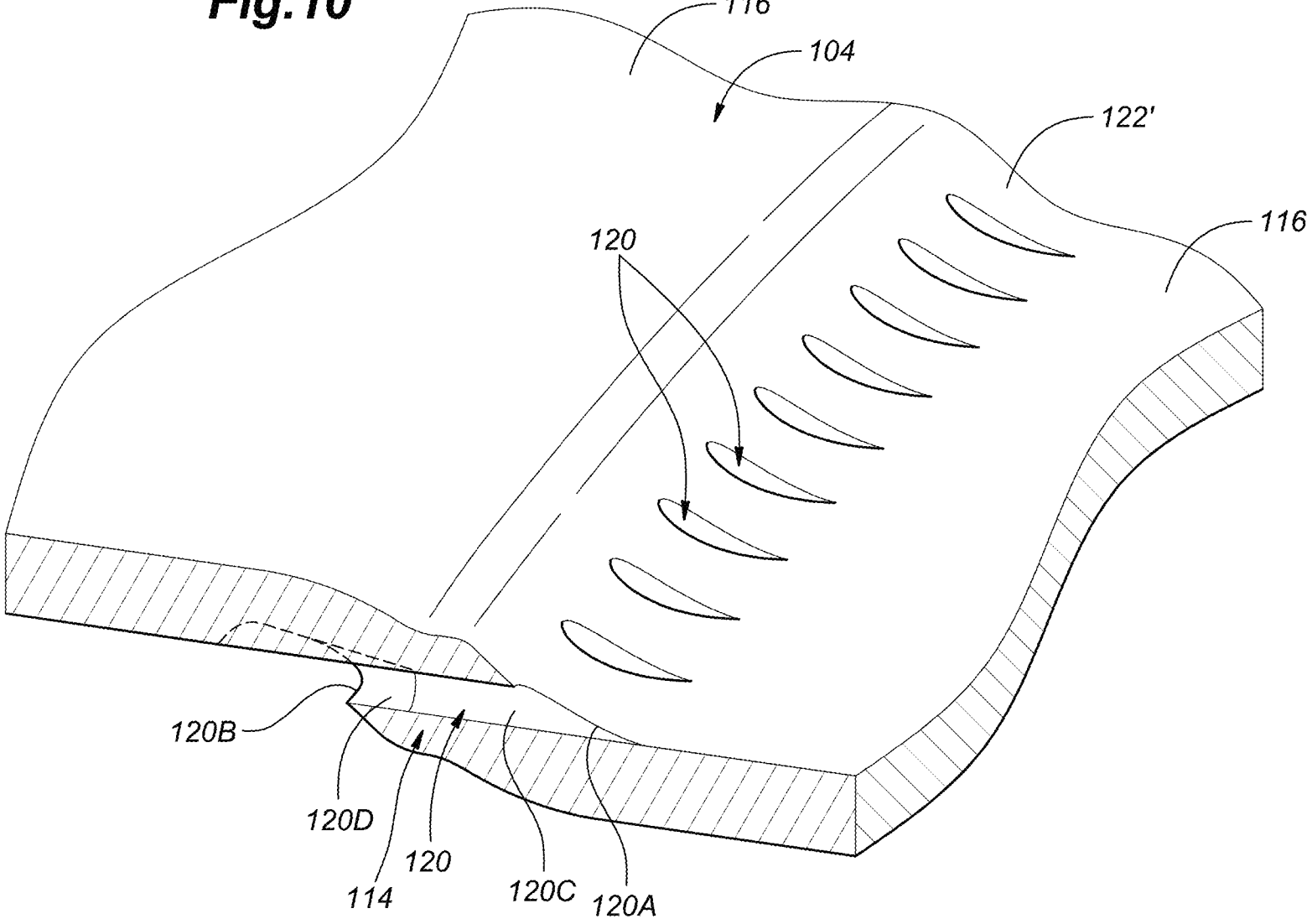
FIG. 10 is a view similar to FIG. 4 showing yet another embodiment of the present invention.

As shown in FIG. 10, the thick wall portion 122' may be formed in a shelf shape extending circumferentially and continuously on the raised wall portion 114, instead of the individual arch-shaped thick wall portions 122. The thick wall portions 122' are thus provided circumferentially and continuously so as to cross the inlets 120A of the cooling air holes 120. Alternatively or additionally, the thick wall portion 122' may be provided so as to cross the outlets 120B of the cooling air holes 120. Thereby, the forming process of the thick wall portion 122' may be simplified.

Figure 11:
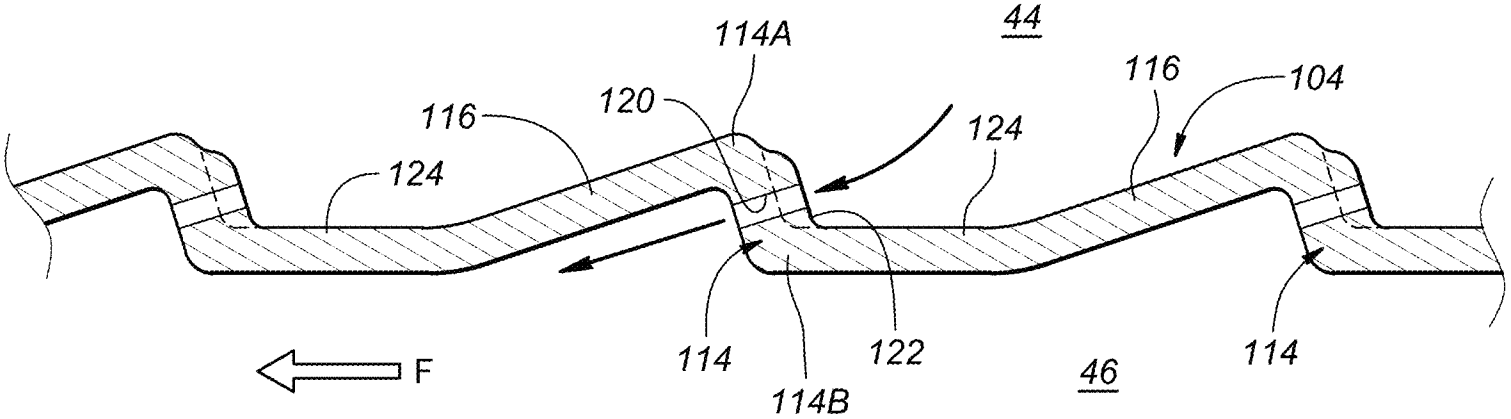
FIG. 11 is a sectional view of the liner of the combustor according to yet another embodiment of the present invention.

In yet another embodiment shown in FIG. 11, a cylindrical wall portion 124 (having no inclination or a substantially smaller inclination than the inclined wall portions 116) is provided between an inner edge portion 114B of each raised wall portion 114 and a downstream edge of the inclined wall portion 116 on the upstream side, as viewed in the flow direction F of the combustion gas in the combustion chamber 46, instead of the inclined wall portion 116 extending entirely between the inner edge portion 114B of each raised wall portion 114 and the outer edge portion 114A of the upstream end of the adjacent raised wall portion 114 on the upstream side. In other words, a downstream part of each inclined wall portion 116 consists of a substantially cylindrical section having a substantially constant diameter around the central axis or having a substantially smaller inclination than the remaining part or the upstream part of the inclined wall portion 116. In this case, the length of the raised wall portions 114 tends to be shorter than the ones in the previous embodiments owing to the presence of the cylindrical wall portions 124 for the given inclination angle of the inclined wall portions 116.

Figure 12:
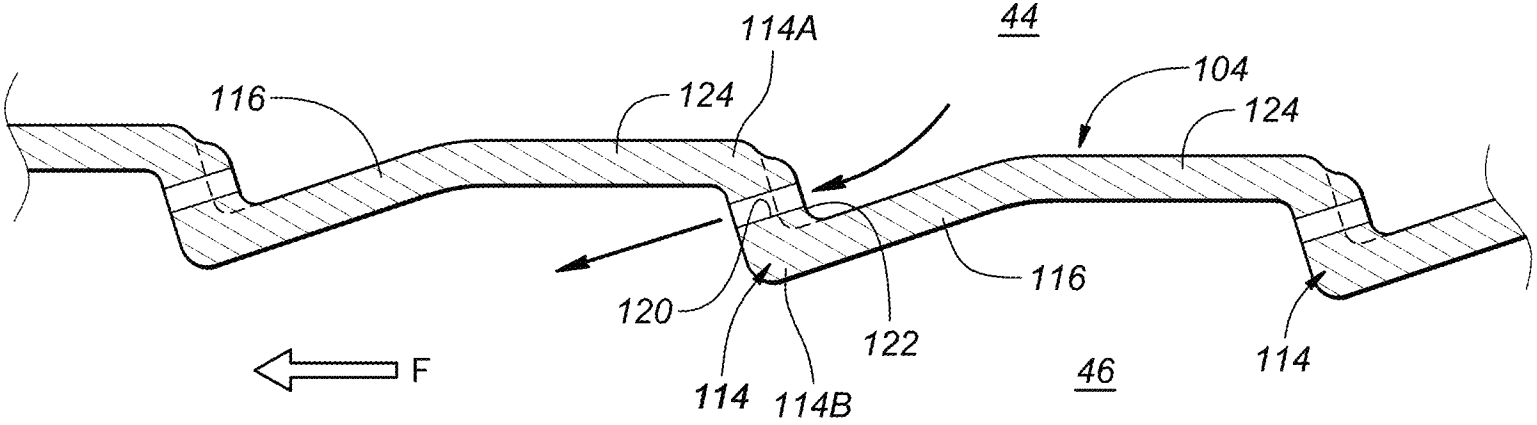
FIG. 12 is a sectional view of the liner of the combustor according to yet another embodiment of the present invention.

In yet another embodiment shown in FIG. 12, a cylindrical wall portion 124 (having no inclination or a substantially smaller inclination than the inclined wall portions 116) is provided between an outer edge portion 114A of each raised wall portion 114 and an upstream edge of the inclined wall portion 116 on the downstream side, as viewed in the flow direction F of the combustion gas in the combustion chamber 46, instead of the inclined wall portion 116 extending entirely between the inner edge portion 114B of each raised wall portion 114 and the outer edge portion 114A of the upstream end of the adjacent raised wall portion 114 on the upstream side. In other words, an upstream part of each inclined wall portion 116 consists of a substantially cylindrical section having a substantially constant diameter around the central axis or having a substantially smaller inclination than the remaining part or the upstream part of the inclined wall portion 116. In this case, the length of the raised wall portions 114 tends to be shorter than the ones in the previous embodiments owing to the presence of the cylindrical wall portions 124 for the given inclination angle of the inclined wall portions 116.

Although the present invention has been described in terms of preferred embodiments thereof, it is obvious to a person skilled in the art that various alterations and modifications are possible without departing from the scope of the present invention which is set forth in the appended claims.

For example, each raised wall portion 114 may be inclined at an inclination angle other than a right angle with respect to the adjacent inclined wall portion 116 in a longitudinal sectional view. In addition, the cooling air holes 120 may penetrate the raised wall portion 114 at an angle other than the right angle with respect to the raised wall portion 114 in a longitudinal sectional view.

The combustor 18 is not limited to an annular type but may also be a can type. In addition, the combustor 18 is not limited to a combustor for a gas turbine engine for power generation and can be applied to combustors for various gas turbine engines, such as combustors for gas turbine engines for aircraft.

The invention claimed is:

1. A combustor for a gas turbine engine that is placed in a compressed air chamber of the gas turbine engine to generate combustion gas, the combustor being provided with a liner that defines a combustion chamber therein around a prescribed central axis, the liner comprising:

a plurality of raised wall portions that extends in a circumferential direction at an angle with respect to the central axis and are arranged at predetermined intervals along the central axis;

a plurality of cooling air holes passed through each of the raised wall portions at a predetermined interval in the circumferential direction; and thick wall portions provided in parts of each of the raised wall portions at ends of the cooling air holes such that each thick wall portion is formed around an outer periphery of an end of a corresponding one of the cooling air holes, wherein the thick wall portions are provided at inlets and/or outlets of the cooling air holes, and the thick wall portions are individually formed in an arcuate shape at the inlets and/or outlets of the cooling air holes such that a recess is defined between each pair of the thick wall portions adjacent to each other in the circumferential direction.

2. The combustor for a gas turbine engine according to claim 1, wherein the cooling air holes each include a flared portion that flares from a side of the compressed air chamber to a side of the combustion chamber.

3. The combustor for a gas turbine engine according to claim 2, wherein the flared portions are progressively enlarged in a circumferential direction from a side of the compressed air chamber to a side of the combustion chamber.

4. The combustor for a gas turbine engine according to claim 2, wherein the flared portions have a trapezoidal cross-sectional shape with a long side thereof located on a radially outer side.

5. The combustor for a gas turbine engine according to claim 2, wherein the flared portions have a triangular cross-sectional shape with a base thereof located on a radially outer side.

6. The combustor for a gas turbine engine according to claim 1, wherein the liner further includes inclined wall portions that are inclined radially inward along the central axis with respect to a flow direction of the combustion gas so as to alternate with the raised wall portion along the central axis.

7. The combustor for a gas turbine engine according to claim 6, wherein the liner further includes cylindrical wall portions that are substantially less inclined than the inclined wall portions and each positioned between one of the raised wall portions and the adjoining inclined wall portion on an upstream side or a downstream side thereof.

* * * * *